US005416490A

United States Patent [19]

Popovic

[11] Patent Number: 5,416,490

[45] Date of Patent: May 16, 1995

[54] BROADBAND QUASI-MICROSTRIP ANTENNA

[75] Inventor: Zorana B. Popovic, Boulder, Colo.

[73] Assignee: The Regents of the University of Colorado, Boulder, Colo.

[21] Appl. No.: 92,973

[22] Filed: Jul. 16, 1993

[51] Int. Cl.[6] ..... H01Q 1/38

[52] U.S. Cl. ..... 343/700 MS; 343/795

[58] Field of Search ..... 343/700 MS, 792.5, 795, 343/830, 853, 793; H01Q 1/38

[56] References Cited

U.S. PATENT DOCUMENTS

| | | | |
|---|---|---|---|
| 4,054,874 | 10/1977 | Oltman, Jr. | 343/700 MS |
| 4,800,392 | 1/1989 | Garay et al. | 343/702 |
| 5,075,691 | 12/1991 | Garay et al. | 343/830 |
| 5,270,671 | 12/1993 | Waterman | 343/700 MS |

OTHER PUBLICATIONS

"Design of a Log Periodic Strip Grating Microstrip Antenna" By R. R. DeLyser et al, International Journal of Microwave and Millimeter-Wave Computer-Aided Engineering, vol. 3, No. 2, (1993) pp. 143-150.

"Multifrequency Operation of Microstrip Antennas Using Aperture Coupled Parallel Resonators" By Croq et al, IEEE Transactions on Antennas and Propagation, vol. 40, No. 11, Nov. 1992, pp. 1367-1374.

*Primary Examiner*—Donald Hajec
*Assistant Examiner*—Tan Ho
*Attorney, Agent, or Firm*—Francis A. Sirr; Jennifer L. Bales; Earl C. Hancock

[57] ABSTRACT

Described is a generally planar antenna having a tapered array of radiating/receiving elements that are transversely mounted in capacitive coupling to an elongated transmission line that underlies the array. The shorter dipole elements resonate at high frequencies, the longer dipole elements resonate at lower frequencies, and the intermediate length dipole elements resonate at intermediate frequencies. The dipole elements are mounted on one surface of a planar dielectric substrate to form a planar, generally triangular shaped pattern having relatively narrow spacing between individual dipole elements (for example, one-twentieth of the wavelength of the intermediate frequencies), and having a relatively large spacing to width ratio. Coupling between the dipole elements causes then to operate as if they were a single broadband dipole element.

12 Claims, 1 Drawing Sheet

BROADBAND QUASI-MICROSTRIP ANTENNA

BACKGROUND OF THE INVENTION

1. Field of the Invention

This invention relates to the field of communications and more specifically to the field of antennas of the microstrip type.

2. Description of the Prior Art

Microstrip antennas generally have limited bandwidth, typically a few percent, and various approaches have been taken to increase the bandwidth of this type of antenna. For example, grated microstrip patches have been investigated in which the appearance of grating modes, in addition to the normal microstrip modes, has the effect of increasing the bandwidth.

U.S. Pat. No. 4,054,874, incorporated herein by reference, describes a mircostrip dipole antenna wherein a plurality of parallel dipole elements are capacitively coupled (i.e., electric field coupled) to a microstrip feed line. The patent suggests that the response of the dipole pair can be adjusted by varying the positions of the pair of dipoles relative to each other and relative to the microstrip line. While dipoles of equal length are preferred, the patent suggests that acceptable results were also obtained having dipoles of different lengths.

The publication INTERNATIONAL JOURNAL OF MICRO-WAVE AND MILLIMETER COMPUTER-AIDED ENGINEERING, Vol. 3, No. 2, at pages 143–150, describes a log periodic strip grating microstrip antenna having narrow patches that are coupled along nonradiating edges. A double layer geometry is provided, and the antenna is mounted above a through line, allowing electromagnetic coupling to all elements of the antenna.

The publication IEEE TRANSACTIONS ON ANTENNAS AND PROPAGATION, Vol. 40, No. 11, November 1992 at pages 1367–1374 describes multifrequency operation of microstrip antennas having parallel dipoles of different lengths that are fed by a microstrip line through a rectangular slot that is cut in the ground plane. In this device, the radiating structure is always centered on the slot and formed of thin dipoles.

While devices of the above type have been generally useful for their limited intended purposes, the need remains in the art for a broadband quasi-microstrip antenna having a planar configuration, and comprising generally a tapered array of radiating/receiving elements that are transversely mounted in capacitively coupled relation to an elongated transmission line underlying the array, the dipole elements being mounted to form a planar, generally triangular-shaped pattern with relatively narrow spacing between the individual dipole elements, but with a relatively large spacing to width ratio.

SUMMARY OF THE INVENTION

This invention relates to a generally planar antenna having a tapered array of radiating/receiving elements transversely mounted in capacitively coupled relation to an elongated transmission line that underlies the element array. The shorter dipole elements of the array are designed for use with high resonant frequencies, the longer dipole elements of the array resonate at lower frequencies, and the intermediate length dipole elements of the array resonate at intermediate frequencies. The dipole elements are mounted to form a planar, generally triangular-shaped pattern, with relatively narrow spacing between the individual dipole elements; for example, one-twentieth of the wavelength of the intermediate frequencies, but with a relatively large spacing to width ratio. This configuration produces a broad bandwidth having a relatively constant 80° 3 db lobe across its frequency range. The spacing between dipole elements is tailored to the intended operating frequencies. That is, the coupling between dipole elements makes the dipole elements operate as if they were a single broadband dipole element.

The art does not teach an array of dipole elements having controlled sequences of lengths and spacing, as presented by this invention.

The invention finds utility in a wide variety of the antenna arts and can, for example, be used to replace patch antennas. As compared to the patch antenna, antennas in accordance with the invention have greater efficiency, work at lower frequencies, have a broader bandwidth, exhibit a single broad response and hence provide a better reflection coefficient, are directive in all directions, and are of a smaller physical size.

Transmitting/receiving antennas, in accordance with the invention, can be used with a wide variety of devices, ranging from radio and microwave to radar and global positioning devices.

The present invention provides a broadband quasi-microstrip antenna in which the microstrip dielectric is air, the antenna consisting of a linear array of generally parallel, thin, tapered length, planar, printed strips or thin cylinder wires. The strips or wires are individually spaced far apart as compared to the width or radius of the individual strips or wires.

An object of the invention is to provide an antenna wherein a planar dielectric substrate member having an upper and a lower surface carries an electrically conductive and linear feedline carried on the lower surface of the substrate member, and a plurality of generally linear and parallel antenna elements on the top surface of the substrate member. The plurality of antenna elements comprising a tapered array of elements having a short element at one end of the array, a long element at the other end of the array, and all elements intermediate the short element and the long elements being of gradually increasing length from the short element and the long element. This plurality of antenna elements overlies the feedline and extends at an angle of about 90 degrees to the feedline. Each of the plurality of antenna elements has a first end that lies on a first line that is parallel to the feedline and is spaced from the feedline on one side thereof, such that each of the plurality of antenna elements extends a common distance to said one side of the feedline. Each of the plurality of antenna elements has a second end the lies on a second line that extends at an angle to the feedline, and is spaced from the feedline on the other side thereof, such that each of the plurality of antenna elements extends a gradually increasing distance to the other side of the feedline from the short element to the long element. A generally planar ground plane is spaced from the lower side of the substrate member, and an air dielectric layer is provided between the ground plane member and the lower side of said substrate member.

As a feature of the invention, the tapered array of elements span an array distance from the short element to the long element, as measured in a direction generally parallel to the feedline, the plurality of elements are of a uniform width and spacing as measured in this direction, and this spacing is relatively large as compared to the width of the elements.

These and other objects and advantages of the invention will be apparent to those of skill in the art upon reference to the following detailed description, which description makes reference to the drawing.

DESCRIPTION OF THE PREFERRED EMBODIMENTS

Figure 2:
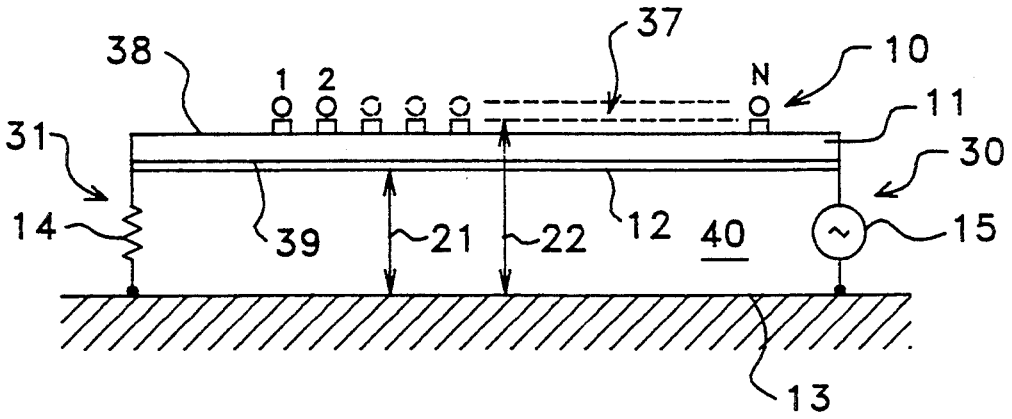
FIG. 2 is a side view of the antenna of FIG. 1.
Figure 1:
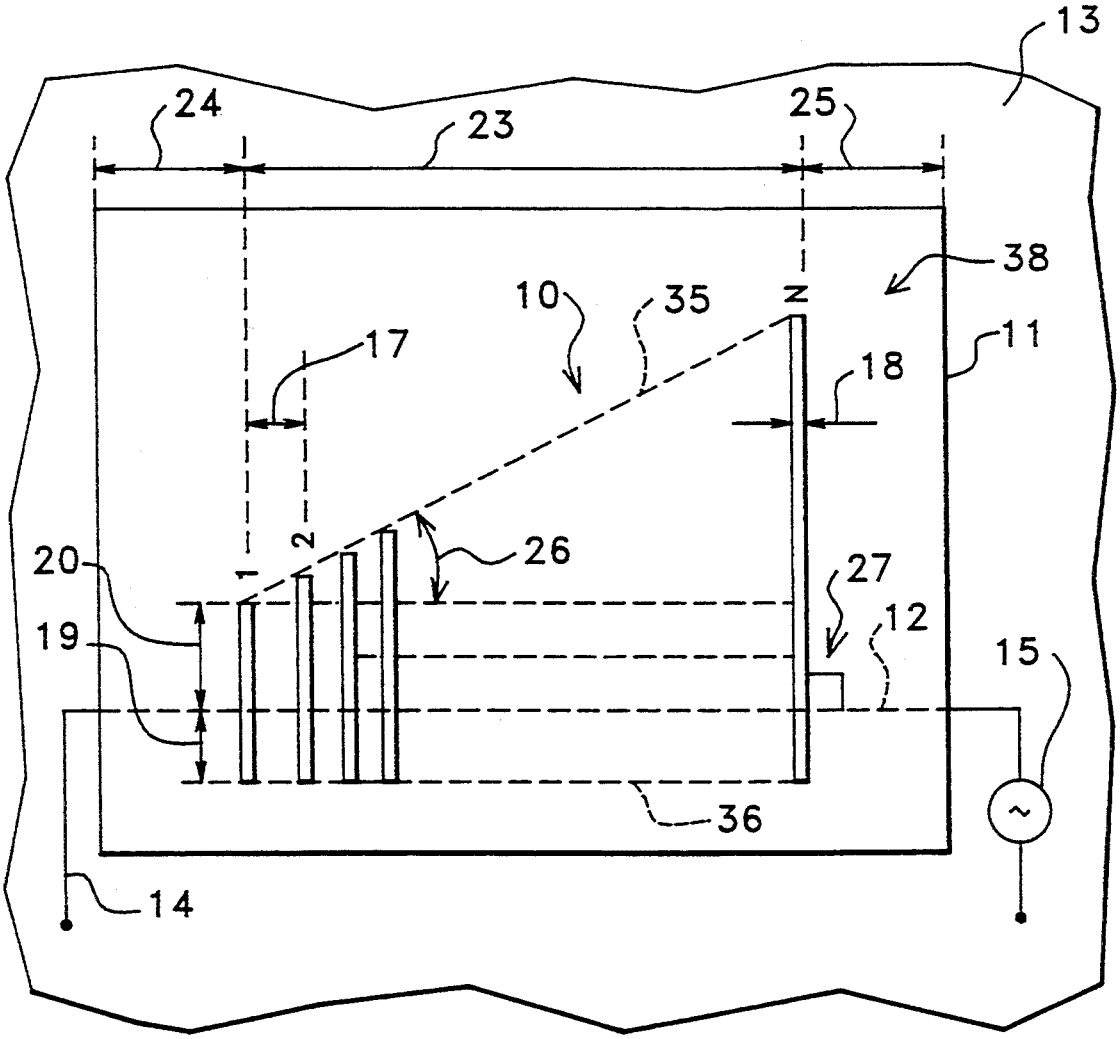
FIG. 1 is a top view of an antenna in accordance with the invention, the antenna having N dipole elements.

This invention relates to microstrip patch antennas wherein the dielectric is air. This antenna, which can be characterized as a quasi-microstrip antenna, consists of a linear array of narrow metal strips, or in the alternative, thin cylindrical metal wires that are individually spaced far apart as compared to the strip width or to the wire radius. FIG. 1 is a top view of an antenna in accordance with the invention, the antenna having N dipole elements, and FIG. 2 is a side view of the antenna of FIG. 1. In an embodiment of the invention to be described, the number N equalled 11.

An array 10 of narrow, parallel, linear or straight, electrically conducting strips or wires, numbered 1 through N, is located above a linear, or straight, electrically conductive metal feed strip 12, and above a ground plane 13 comprising what in practice can be considered to be an infinite area ground plane. Feedstrip 12 and ground plane 13 form a transmission line that is connected to an input generator 15 at one end 30 of transmission line 12,13. Transmission line 12,13 is terminated at the other end 31 in the characteristic impedance 14 of the transmission line. In an embodiment of the invention wherein the width or diameter of feed line 12 was about 0.254 mm, the impedance of the feed line alone was about 283 ohms.

Antenna elements 1-N and feed line 12, which may comprise printed electrical conductors, are respectively supported by the flat and parallel upper and lower surfaces 38,39 of a dielectric substrate member 11. An exemplary substrate member 11 comprised a flat panel of the brand Styrofoam expanded cellular polystyrene about 1 mm thick and about 10 cm square, and elements 1-N and feed line 12 comprised copper tape.

This antenna is characterized as a quasi-microstrip antenna in that the plane 37 of element array 10 is generally about 1/10th of the antenna's operating wavelength above ground plane 13 (see distance 22 of FIG. 2), the antenna comprises a set or array of narrow strips or equivalent wires, and the antenna's dielectric is air. The antenna has an anisotropic radiation pattern in that current can flow only along the thin strips 1-N of array 10. A plot of current versus frequency shows that the different elements 1-N have strong radiating currents at frequencies corresponding to their lengths 19+20.

Reference numeral 17 designates the uniform or equal period or spacing of the individual dipole elements 1-N of array 10. All elements are spaced by this distance 17. Reference numeral 18 designates the uniform, or equal, width of the individual dipole elements 1-N of array 10. All of the elements 1-N are of this width 18. In accordance with a feature of the invention, the period 17 of array 10 is much greater than the width of array strips 1-N; for example, a period of about 5.00 mm as compared to a width of about 0.245 mm, or a ratio of about 20 to 1.

As seen in FIG. 1, each of the individual elements 1-N extends in a direction generally normal to feed line 12 (see right angle 27). Each of the elements 1-N extends a common distance 19 below, or to one side of, feed line 12. However, each of the elements 1-N extends a variable length or distance 20, above or to the other side of, feed line 12. The variable length 20 of elements 1-N forms a generally triangular area designated by broken lines 35,36, line 35 designating a taper extending at an angle 26 to line 36. By way of example, common distance 19 is about 10 mm, length 20 of element 1 is about 58 mm, length 20 of element N is about 72 mm, and angle 26 is about 11.3 degrees.

Feed line 12 is at a height 21 above ground plane 13, whereas the plane 37 of element array 10 is at a height 22 above ground plane 13. In an embodiment of the invention, the distance 21 was about 8 mm and the distance 22 was about 9 mm. The effective length of the antenna patch is designated by reference numeral 23, and was an exemplary distance of about 5 cm when the number N of elements equaled 11 elements. In this embodiment of the invention, the lengths 24,25 shown in FIG. 1 were both about 2 cm.

From the above detailed description it can be seen that an antenna is provided wherein a planar dielectric substrate member 11, having a generally planar and parallel upper surface 38 and lower surface 39, carries an electrically conductive and linear feedline 12 on its lower surface, and a plurality of generally linear and parallel antenna elements numbered 1-N on its top surface. The plurality of antenna elements 1-N comprise a tapered array 10 of elements having a short element 1 at one end of the array, a long element N at the other end of array, and all elements intermediate the short element and the long element being of gradually-increasing length. The plurality of antenna elements 1-N overlie feedline 12 and extends at an angle of about 90 degrees to the feedline. Each of the plurality of antenna elements 1-N has a first end that lies on a first line 36 that is parallel to feedline 12, and is spaced from the feedline on one side thereof such that each of the plurality of antenna elements extend a common distance 19 to the one side of the feedline. Each of the plurality of antenna elements 1-N has a second end that lies on a second line 35 that extends at an angle 26 to feedline 12 and is spaced from the feedline on the other side thereof, such that each of the plurality of antenna elements extend a gradually-increasing distance to the other side of the feedline from short element 1 to long element N. A generally planar ground plane 13 is spaced from the lower side of substrate member 11, and an air dielectric layer 40 is provided between ground plane 13 and said lower side of substrate member 11.

It is to be recognized that those skilled in the art will readily visualize yet other embodiments of the invention that are within the spirit and scope of the invention. Thus, the above detailed description is not to be taken as a limitation on the invention.

What is claimed is:

1. An antenna, comprising:

a dielectric substrate having an upper and a lower surface, an electrically conductive and generally linear feedline carried by said lower surface of said substrate, a plurality of generally linear and parallel antenna elements carried by said top surface of said substrate member, said plurality of antenna elements comprising a tapered array of elements having a short element at one end of said array, a long element at the other end of said array, and all elements intermediate said short element and said long elements being of gradually increasing length from said short element to said long element, said plurality of antenna elements overlying said feed line and extending at an angle of about 90 degrees to said feedline, each of said plurality of antenna elements having a first end that lies on a first line that is parallel to said feedline and is spaced from said feedline on one side thereof, such that each of said plurality of antenna elements extends a common distance to said one side of said feedline, each of said plurality of antenna elements having a second end that lies on a second line that extends at an angle to said feedline, and is spaced from said feedline on the other side thereof, such that each of said plurality of antenna elements extend a gradually increasing distance to said other side of said feedline from said short element to said long element, such that each of said plurality of antenna elements forms a dipole antenna driven off-center by said feedline, a ground plane spaced from said lower side of said substrate, a dielectric layer between said ground plane member and said lower side of said substrate, wherein said tapered array of elements span an array distance from said short element to said long element, as measured in a direction generally parallel to said feedline, wherein said plurality of elements have spacing gaps between them, said gaps at least twice as wide as the width of the elements, said spacing gaps, the angle between said feedline and said second line, and the number of elements are selected such that said elements are strongly mutually coupled, in order to act as a single broadband antenna.

2. The antenna of claim 1 wherein said spacing gap and said element width are in a ratio of about 20 to 1.

3. The antenna of claim 1 wherein said array distance is about 5 cm, said spacing gap is about 0.5 cm, and said element width is about 0.254 mm.

4. The antenna of claim 3 wherein said dielectric layer is air and which further includes;

a generator connected to one end of said feedline, and an impedance generally equal to the characteristic impedance of a transmission line that comprises said feedline and said ground plane connected to the other end of said feedline, such that a low standing wave ratio is maintained on said feed line over a broad frequency range.

5. The antenna of claim 1 wherein said second line extends at an angle of about 11.3 degrees to said feedline.

6. The antenna of claim 1 wherein said common distance to said one side of said feedline is about 10 mm.

7. The antenna of claim 6 wherein said plurality of antenna elements equals eleven, and wherein said short element extends a distance of about 58 mm to said other side of said feedline, and said long element extends a distance of about 72 mm to said other side of said feedline.

8. The antenna of claim 6 wherein said plurality of antenna elements lie in a plane that is spaced about 9 mm from said ground plane, and said feedline is spaced about 8 mm from said ground plane.

9. The antenna of claim 8 wherein said plurality of antenna elements span an array distance of about 5 cm from said short element to said long element.

10. The antenna of claim 9 wherein said plurality of elements are of a uniform element width and spacing gap as measured in said direction, and wherein said spacing gap is relatively large as compared to said element width.

11. The antenna of claim 10 wherein said spacing gap and said element width are in a ratio of about 20 to 1.

12. The antenna of claim 11 wherein said array distance is about 5 cm, said spacing gap is about 0.5 cm, and said element width is about 0.254 mm.

* * * * *